US008747017B2

(12) United States Patent
Dag

(10) Patent No.: US 8,747,017 B2
(45) Date of Patent: Jun. 10, 2014

(54) RESILIENT INFLATABLE DELINEATORS

(76) Inventor: Stefan Albrecht Dag, Carbondale, CO (US)

( * ) Notice: Subject to any disclaimer, the term of this patent is extended or adjusted under 35 U.S.C. 154(b) by 0 days.

(21) Appl. No.: 13/370,922

(22) Filed: Feb. 10, 2012

(65) Prior Publication Data

US 2012/0269575 A1 Oct. 25, 2012

Related U.S. Application Data

(60) Provisional application No. 61/477,439, filed on Apr. 20, 2011.

(51) Int. Cl.
*E01F 9/019* (2006.01)
*E01F 9/017* (2006.01)

(52) U.S. Cl.
CPC ..... *E01F 9/0175* (2013.01)
USPC ..... 404/9; 404/10; 256/73

(58) Field of Classification Search
CPC ..... E01F 9/0175
USPC ..... 404/6, 9–11; 256/73; 116/63 C, 63 R, 116/63 T
See application file for complete search history.

(56) References Cited

U.S. PATENT DOCUMENTS

| | | | | | |
|---|---|---|---|---|---|
| 2,765,014 | A * | 10/1956 | Muller | 52/2.21 |
| 2,800,099 | A * | 7/1957 | Baker | 116/63 R |
| 3,877,096 | A * | 4/1975 | Scesney | 441/6 |
| 3,892,081 | A * | 7/1975 | Goral | 40/214 |
| 4,270,873 | A | 6/1981 | Laehy et al. | |
| 5,047,107 | A * | 9/1991 | Keller et al. | 156/184 |
| 5,054,955 | A | 10/1991 | Habernig | |
| 5,257,874 | A | 11/1993 | Kato et al. | |
| 5,421,128 | A * | 6/1995 | Sharpless et al. | 52/2.13 |
| 5,546,707 | A * | 8/1996 | Caruso | 52/2.13 |
| 6,176,642 | B1 * | 1/2001 | Hinterholzer | 404/10 |
| 6,279,254 | B1 * | 8/2001 | Gill et al. | 40/439 |
| 6,389,659 | B1 * | 5/2002 | Jacobs | 24/573.09 |
| 6,668,475 | B2 * | 12/2003 | Carolan | 40/610 |
| 6,758,003 | B2 * | 7/2004 | Zheng | 40/610 |
| 6,804,905 | B1 * | 10/2004 | Burger et al. | 40/610 |
| 7,490,426 | B2 * | 2/2009 | Scarberry | 40/610 |
| 7,836,619 | B2 * | 11/2010 | Coutts | 40/218 |
| 2010/0266337 | A1 * | 10/2010 | Lapointe et al. | 404/11 |

FOREIGN PATENT DOCUMENTS

| | | | | |
|---|---|---|---|---|
| GB | 2229462 | * | 3/1989 | E01F 15/00 |
| JP | 2000297412 | A | 10/2000 | |
| WO | 2010132264 | A1 | 11/2010 | |

OTHER PUBLICATIONS

International Search Report and Written Opinion from corresponding International Patent Application No. PCT/US2012/033732 issued Oct. 8, 2012.

* cited by examiner

*Primary Examiner* — Raymond W Addie
(74) *Attorney, Agent, or Firm* — Maier & Maier, PLLC

(57) ABSTRACT

A resilient inflatable delineator pole. The delineator pole can include an elongated body enclosing an interior chamber, a flap disposed at a bottom end of the body and having an aperture defined therein, a retention structure for retaining a lower portion of the body within a granular medium, at least one valve disposed on the elongated body and in communication with the interior chamber, and a protective sleeve enclosing a portion of the elongated body.

1 Claim, 4 Drawing Sheets

RESILIENT INFLATABLE DELINEATORS

RELATED APPLICATIONS

The present invention claims priority under 35 U.S.C. §120 to U.S. Provisional Patent Application No. 61/477,439, filed on Apr. 20, 2011, entitled "FLEXIBLE INFLATABLE DEVICE", the disclosure of which is incorporated by reference herein in its entirety.

BACKGROUND

Delineator poles and gates are frequently used in applications such as sports, crowd control, traffic control, safety markers, and the like. For example, in slalom skiing, delineator poles and gates are used to mark the path that the skier must navigate to successfully complete the course. As another example, delineator poles may be used in field sports training to form obstacle courses for improving the agility of the players. Traffic delineators may be used to demarcate areas prohibited to vehicular traffic or to guide traffic within a predetermined path.

Known delineator poles and gates are typically constructed of rigid, impact-resistant materials and are adapted to pivot upon impact with an object. To that end, such delineators can include springs or other structures within the delineator for the purpose of returning the delineator into an upright position after impact. However, the rigid material and the return mechanisms result in such delineators having a significant weight. In applications such as slalom skiing, the transport of delineators over the mountain slope requires a substantial energy and personnel investment due to the weight of the delineators.

Additionally, impacts with heavy delineators constructed of rigid materials can be painful, can cause injury to the person, or can cause damage to a vehicle or other object. While the pivoting delineators reduce the likelihood of injury or damage, the risk of injury or damage is nevertheless significant, especially delineator impacts the person or object in a vulnerable location.

Due to the aforementioned disadvantages of known delineator poles and gates, a lightweight delineator that minimizes the risk of injury or damage upon impact is therefore desired.

SUMMARY

According to at least one exemplary embodiment, a resilient inflatable delineator pole is disclosed. The delineator pole can include an elongated body enclosing an interior chamber, a flap disposed at a bottom end of the body and having an aperture defined therein, a retention structure for retaining a lower portion of the body within a granular medium, at least one valve disposed on the elongated body and in communication with the interior chamber, and a protective sleeve enclosing a portion of the elongated body.

According to another exemplary embodiment, a resilient inflatable gate is disclosed. The resilient inflatable gate can include a pair of resilient inflatable delineator poles, at least one resilient transverse inflatable beam coupled to each of the pair of delineator poles, and a marker coupled to the at least one transverse inflatable beam.

According to another exemplary embodiment, a system for resilient inflatable delineators, is disclosed. The system can include at least one resilient inflatable delineator pole and an insertion member for inserting the at least one resilient inflatable delineator pole into a granular medium. The system can further include at least two resilient inflatable delineator poles and at least one resilient transverse inflatable beam coupleable to the at least two resilient inflatable delineator poles. The system can further include a base for maintaining the at least one resilient inflatable delineator pole on a non-penetrable surface.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
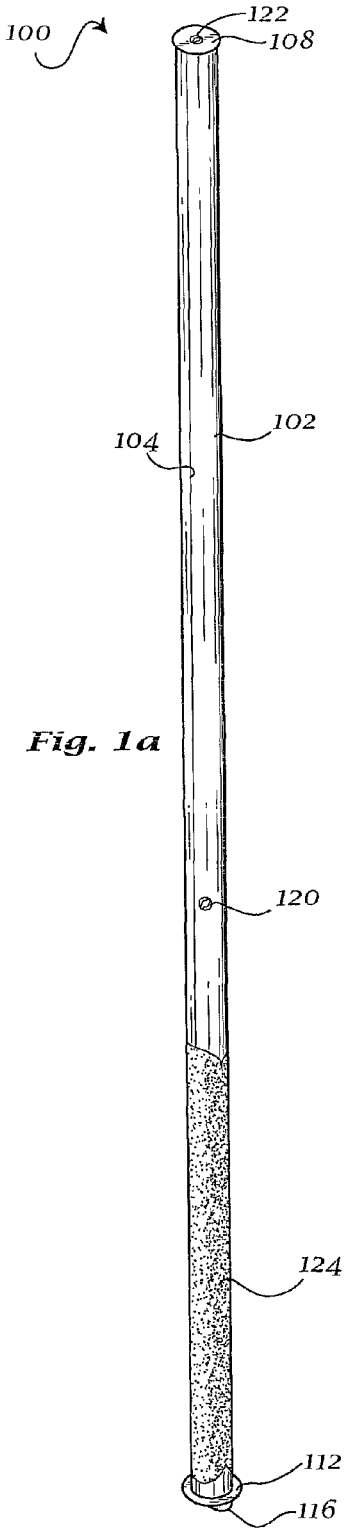
FIG. 1*a* is an isometric view of an exemplary embodiment of a resilient inflatable delineator pole.
Figure 1B:
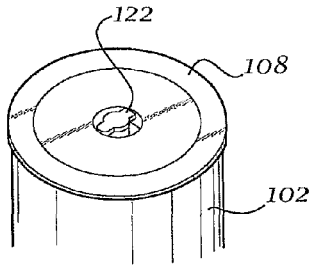
FIG. 1*b* is an isometric view of the top portion of an exemplary embodiment of a resilient inflatable delineator pole.
Figure 1C:
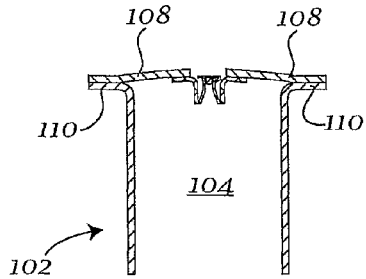
FIG. 1*c* is a cross-sectional view of the top portion of an exemplary embodiment of a resilient inflatable delineator pole.
Figure 1D:
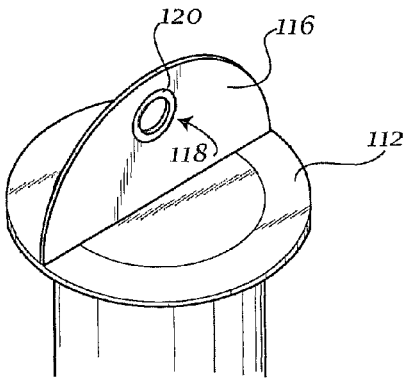
FIG. 1*d* is an isometric view of the bottom portion of an exemplary embodiment of a resilient inflatable delineator pole.
Figure 1E:
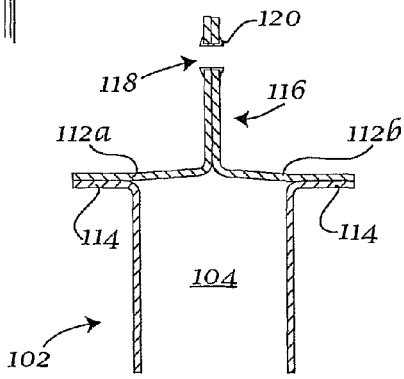
FIG. 1*e* is a cross-sectional view of the bottom portion of an exemplary embodiment of a resilient inflatable delineator pole.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to FIGS. 1*a*-5*b*, embodiments of resilient inflatable delineators may be disclosed. The resilient inflatable delineators may include at least one elongated body. The body may be formed from any suitable material that enables the delineator to function as described herein. The body may further be constructed from at least one sheet of the suitable material, which can be rolled so as to form a hollow tube, or may be constructed from a pair of sheets of the suitable material. The body may further include top and bottom caps so as to enclose an interior chamber within the hollow tube and between the top and bottom caps. The edges of the material may then be adhered, adjoined, sewn, or otherwise attached to each other so as to form a seam, which can extend along the body. The seam may further be disposed within the interior chamber such that there are no protruding edges on the exterior of the body that may cause injury or damage to an impacting object, or damage to the delineator itself. The seam may be formed so as create an airtight seal, allowing any gas to be retained within the interior chamber of the delineator. The top and bottom caps may be formed from the same material as the hollow tube and may be sealed in the same manner as the edges of the sheet of material from which the hollow tube is formed.

At least one valve may be provided on the exterior of the body of the delineator, the valve being in communication with the interior chamber of the body. The valve can facilitate transfer of gas into and out of the interior chamber. The valve may be operable orally by the user, or may be adapted to couple to any known air pump or other inflation device. The air valve may be located at any point along tubular enclosure, and may be adapted to create an airtight seal subsequent to operation. The valve may be a self-sealing valve, or may be sealed by the user. Furthermore, the valve may be a one-way or two-way valve. In some embodiments, a one-way self-sealing inflation valve and a two way user-sealable valve may be provided at different points on the body of the delineator.

A guard sleeve enclosing a portion of the delineator may be provided so as protect the body of the delineator from rupture due to impact with objects. The guard sleeve may be formed from a material having higher resistance to cutting and abrasion than the material from which the body of the delineator is formed. For example, in skiing applications, the guard sleeve may be disposed substantially near the bottom of the body of the delineator so as to protect the body from rupture by slicing cuts due to impacts from skis.

Embodiments of delineators disclosed herein may further include insertion and retention structures for inserting and maintaining the delineator within a granular medium such as snow, soil, sand, gravel, or any other such medium. The insertion structures may be adapted to couple to an insertion member to facilitate the insertion of a portion of the delineator into the granular medium. The retention structures may be adapted to retain a portion of the delineator within the granular medium and may be fully disposed within the granular medium when the delineator is in use. The retention structures may also be adapted to couple to a base member for disposing the delineator on hard, non-penetrable surface, such as asphalt, concrete, or the like.

Turning to FIGS. 1*a*-1*e*, a first exemplary embodiment of a resilient inflatable delineator pole 100 may be shown. Delineator pole 100 may include an elongated, substantially cylindrical body formed from at least one sheet of material rolled so as to form a hollow tube 102 enclosing an interior chamber 104. The edges of the sheet of material may be adhered to each other by any known adhesive or manner of adhesion, so as to form an airtight, durable, and temperature-resistant seam 106 extending lengthwise along the body of delineator pole 100.

A top cap 108 may be coupled to the top of hollow tube 102 so as to form an airtight seal between the top edge of hollow tube 102 and top cap 108. Such a seal may be formed, for example, by bending the top edge of hollow tube 102 so as to form a flange 110 and adhering flange 110 to top cap 108. The hollow tube and the top cap may be adhered by any known adhesive or manner of adhesion that can form an airtight, durable, and temperature-resistant seal between hollow tube 102 and top cap 108.

A bottom cap 112 may be coupled to the bottom of hollow tube 102 so as to form an airtight seal between the bottom edge of hollow tube 102 and bottom cap 112. Such a seal may be formed, for example, by bending the bottom edge of hollow tube 102 so as to form a flange 114 and adhering flange 114 to bottom cap 112. The hollow tube and the bottom cap may be adhered by any known adhesive or manner of adhesion that can form an airtight, durable, and temperature-resistant seal between hollow tube 102 and bottom cap 112.

Bottom cap 112 may include a flap 116 extending substantially diametrically across bottom cap 112. Flap 116 may be pivotally adhered to bottom cap 112. Alternatively, bottom cap 112 may be formed from two substantially circular portions 112*a*, 112*b*. A first half of each of portions 112*a*, 112*b* may be adhered to hollow tube 102 as described above so as to form bottom cap 112, while a second half of portion 112*a* may be coupled to a second half of portion 112*b* so as to form pivotable flap 116.

Flap 116 may serve as an insertion structure for inserting delineator pole 100 into a granular medium. To that end, flap 116 may include therein an aperture 118, which may be reinforced by a grommet 120. Aperture 118 and grommet 120 may be adapted to receive a portion of an insertion member 400, which is described in further detail below.

Bottom cap 112 may serve as a retention structure for maintaining delineator pole 100 within a granular medium. To that end, bottom cap 112 may have a diameter greater than the diameter of hollow tube 102, and may be positioned in a plane perpendicular to the longitudinal axis of hollow tube 102. Thus, when a force is exerted on delineator pole 100, the top surface of bottom cap 102 that is exposed to the granular medium may exert a counterforce against the granular medium so as to maintain delineator pole 100 in place.

A first valve 120 may be provided on hollow tube 102 and may be in communication with interior chamber 104. First valve 120 may be a one way, self sealing valve, and may be utilized for inflation of delineator pole 100 by input of gas into interior chamber 104. First valve 120 may be operable orally by the user, or may be adapted to couple to any known air pump or other inflation device. First valve 120 may be positioned along hollow tube 102 such that the valve is easily accessible when delineator pole 100 is disposed upright in a desired location. Reinforcing structures may be provided as needed for mounting and maintaining first valve 120 on hollow tube 102.

A second valve 122 may be provided within top cap 108 and may be in communication with interior chamber 104. Second valve 122 may be a two way, user-sealable valve, and may be utilized for deflation of delineator pole 100 by withdrawal of gas from interior chamber 104. Reinforcing structures may be provided as needed for mounting and maintaining second valve 122 on hollow tube 102.

A guard sleeve 124 may be provided to enclose a portion of delineator pole 100. Guard sleeve 124 may be formed from a material having higher resistance to cutting and abrasion than the material from which the body of delineator pole 100 is formed. Guard sleeve 100 may be disposed so as to enclose a portion of delineator pole 100. For example, in skiing applications, guard sleeve 100 may be disposed substantially near the bottom of the body of delineator pole 100 so as to protect the body from rupture by slicing cuts due to impacts from skis.

Figure 2A:
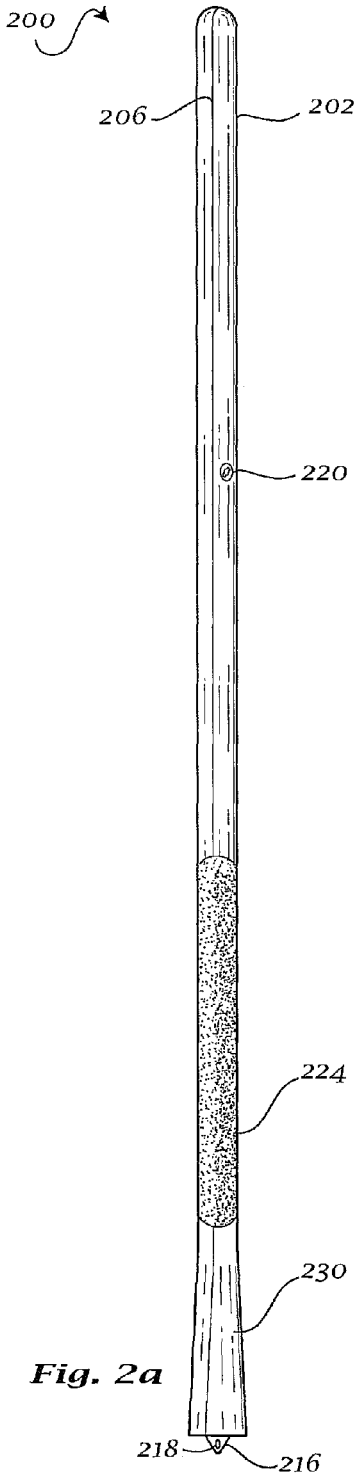
FIG. 2*a* is an elevational view of another exemplary embodiment of a resilient inflatable delineator pole.
Figure 2B:
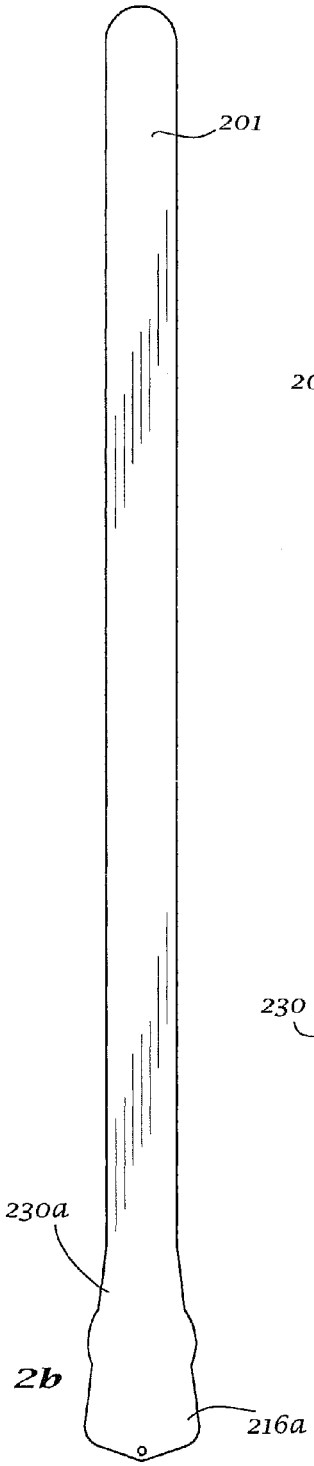
FIG. 2*b* is an elevational view a sheet of material for forming the exemplary embodiment of FIG. 2*a*.
Figure 2C:
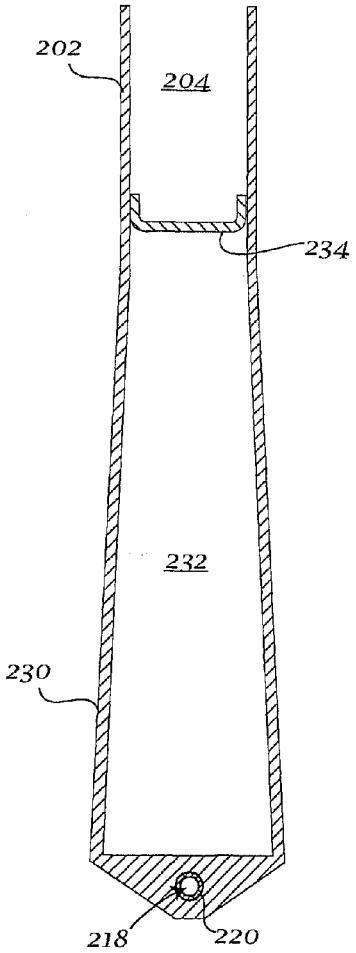
FIG. 2*c* is a cross-sectional view of the bottom portion of the exemplary embodiment of FIG. 2*a*.

Turning to FIGS. 2*a*-2*c*, a second exemplary embodiment of a resilient inflatable delineator pole 200 may be shown. Delineator pole 200 may include an elongated body formed from a pair of sheets of material 201 coupled so as to form an elongated enclosure 202 enclosing an interior chamber 204. The edges of sheets 201 may be adhered to each other by any known adhesive or manner of adhesion, so as to form an airtight, durable, and temperature-resistant seam 206 extending around the body of delineator pole 200. Seam 206 may be an internal seam disposed within interior chamber 204.

Elongated enclosure 202 can include a flap 216 disposed at the bottom thereof. Each sheet of material 201 may include a flap portion 216*a*. The flap portions 216*a* may be adhered to each other so as to form the bottom face of elongated enclosure 202 as well as to form pivotable flap 216.

Flap 216 may serve as an insertion structure for inserting delineator pole 200 into a granular medium. To that end, flap 216 may include therein an aperture 218, which may be reinforced by a grommet 220. Aperture 218 and grommet 220 may be adapted to receive a portion of an insertion member 400, which is described in further detail below.

A valve 220 may be provided on elongated enclosure 202 and may be in communication with interior chamber 204. Valve 220 may be a two way, self sealing valve, and may be utilized for inflation and deflation of delineator pole 200 by transfer of gas into or out of interior chamber 204. Valve 220 may be operable orally by the user, or may be adapted to couple to any known air pump or other inflation device. Valve 220 may be positioned along elongated enclosure 202 such that the valve is easily accessible when delineator pole 200 is disposed upright in a desired location. Reinforcing structures may be provided as needed for mounting and maintaining valve 220 on hollow tube 202.

A bottom portion of elongated enclosure 202 may flare outwards so as to form a retention cone 230. Retention cone 230 may have a substantially frustoconical shape, with the diameter of retention cone 230 increasing towards the bottom of the retention cone. Each sheet 201 may include a flared portion 230*a* which has a greater width than the remaining portion of sheet 201. The flared portions 230*a* may be adhered to each other so as to form retention cone 230.

Retention cone 230 may serve as a retention structure for maintaining delineator pole 200 within a granular medium. As the diameter of retention cone 230 progressively increases, when a force is exerted on delineator pole 100, the outer surface of retention cone 230 exert a counterforce against the granular medium so as to maintain delineator pole 200 in place. In some embodiments, the interior chamber 232 of retention cone 230 may be part of interior chamber 204 of elongated enclosure 202. In other embodiments, a separator 234 may be provided between cone interior chamber 232 and interior chamber 204. Separator 234 may be adhered to the interior wall of elongated enclosure 202 by any known adhesive or manner of adhesion, so as to form an airtight, durable, and temperature-resistant seal. Cone interior chamber 232 may then be filled with a gas composition that is heavier than the gas composition in interior chamber 204. Alternatively, cone interior chamber 232 may be filled by a solid or liquid so as to facilitate maintaining delineator pole 200 within a granular medium or on top of a hard, non-penetrable surface.

A guard sleeve 224 may be provided to enclose a portion of delineator pole 200. Guard sleeve 224 may be formed from a material having higher resistance to cutting and abrasion than the material from which the body of delineator pole 200 is formed. Guard sleeve 200 may be disposed so as to enclose a portion of delineator pole 200. For example, in skiing applications, guard sleeve 200 may be disposed substantially near the bottom of the body of delineator pole 200 so as to protect the body from rupture by slicing cuts due to impacts from skis.

Figure 3A:
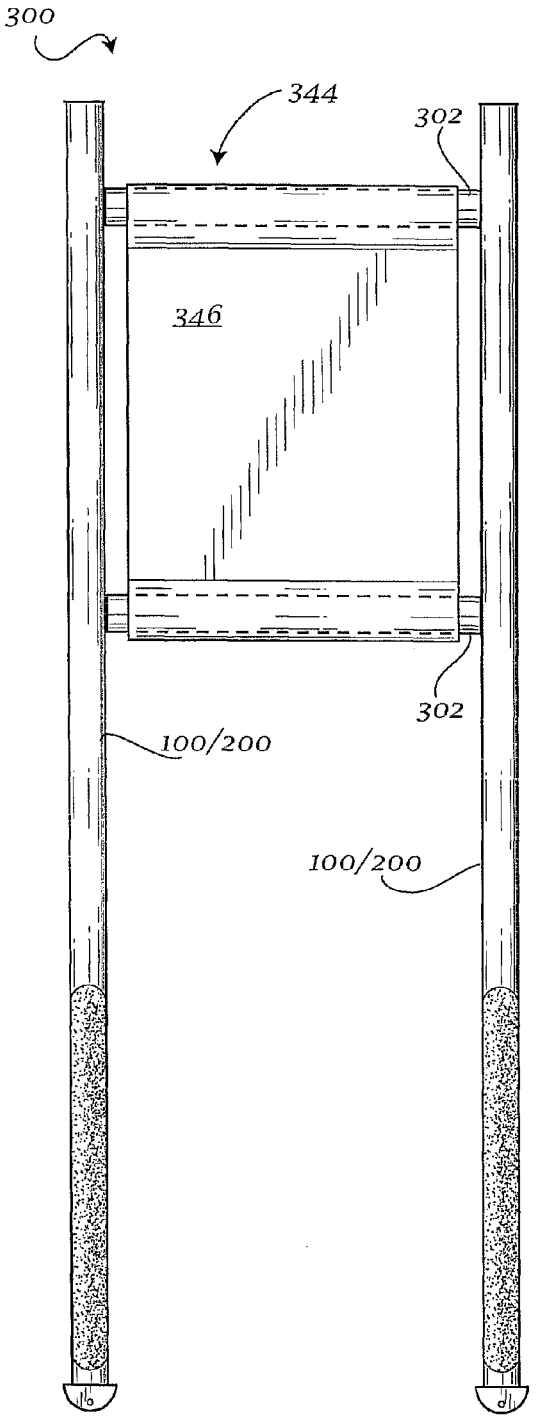
FIG. 3*a* is an elevational view of another exemplary embodiment of a resilient inflatable gate.
Figure 3B:
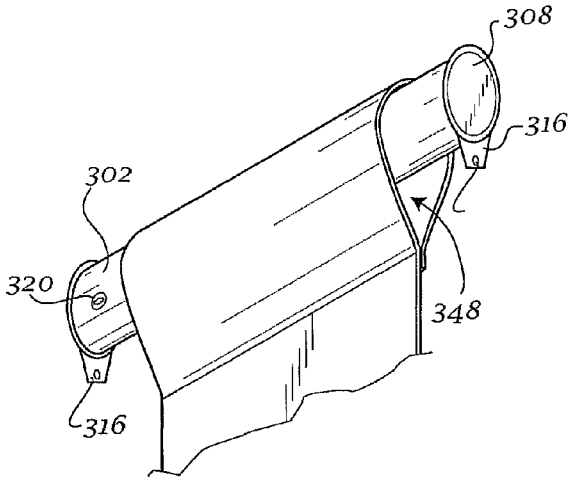
FIGS. 3*b*-3*c* are partials isometric view of an exemplary embodiment of transverse inflatable beam of a resilient inflatable gate.
Figure 3C:
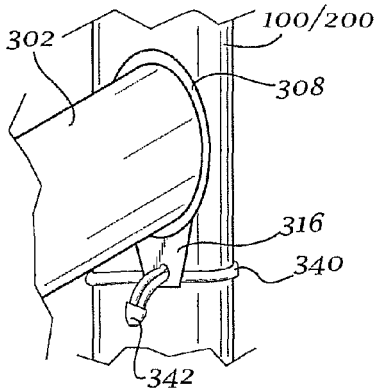

Turning to FIGS. 3*a*-3*c*, an exemplary embodiment of a resilient inflatable gate 300 may be shown. Gate 300 may include a pair of delineator poles 100/200 acting as vertical supports for at least one resilient transverse inflatable beam 302.

Transverse inflatable beam 302 may have an elongated, substantially cylindrical body formed from at least one sheet of material rolled so as to form beam 302 enclosing an interior chamber 304. The edges of the sheet of material may be adhered to each other by any known adhesive or manner of adhesion, so as to form an airtight, durable, and temperature-resistant seam 306 extending lengthwise along the body of beam 300. End caps 308 may be coupled to each end of beam 302 so as to form an airtight seal between the edges of beam 302 and each end cap 308. Such a seal may be formed, for example, by bending the outer edges of beam 302 so as to form flanges and adhering each flange to each end cap 308. The hollow tube and the top cap may be adhered by any known adhesive or manner of adhesion that can form an airtight, durable, and temperature-resistant seal between beam 302 and each end cap 308.

A valve 320 may be provided on beam 302 and may be in communication with interior chamber 304. Valve 320 may be a two way, self sealing valve, and may be utilized for inflation and deflation of beam 302 by transfer of gas into or out of interior chamber 304. Valve 220 may be operable orally by the user, or may be adapted to couple to any known air pump or other inflation device.

Transverse inflatable beam 302 may be coupled to delineator poles 100/200 by any known coupling, for example by adhesives, by known fasteners, and the like. In some exemplary embodiments, each end cap 308 may include a tab 316 extending outwardly therefrom. Tab 316 may include therein an aperture 318, which may be reinforced by a grommet. A fastening loop 340 may be inserted through aperture 318 and encircled around a delineator pole 100/200. A rope clip 342 may be coupled to the free ends of fastening loop 340 and disposed on the opposite side of aperture 318. Rope clip 342 can facilitate maintaining fastening loop 340 within aperture 318 as well as increasing or decreasing the diameter of the fastening loop for securing the loop to the delineator poles.

Coupled to at least one transverse inflatable beam 302 may be a marker 344. Marker 344 may be a sheet, flag, sign, object, and may have any desired color or appearance. Marker 344 may further be coupled to at least one transverse inflatable beam by any known coupling. In some exemplary embodiments, marker 344 may be formed from a single sheet of material 346. At least one edge of sheet 346 may be rolled so as to enclose a sleeve 348, and coupled to sheet 346. Beam 302 may then be received within sleeve 348, thereby supporting the marker.

Figure 4:
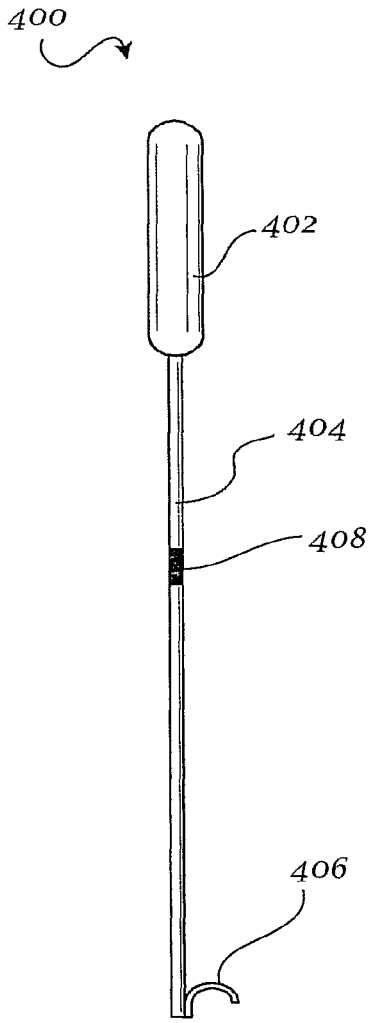
FIG. 4 is an elevational view of an exemplary embodiment of an insertion member for a resilient inflatable delineator pole.

Turning to FIG. 4, an exemplary embodiment of insertion member 400 may be shown. Insertion member 400 can facilitate inserting embodiments of delineator pole 100/200 into a granular medium. Insertion member 400 can include a handle 402, an elongated insertion rod 404, and a hook 406 disposed at the distal end of insertion rod 404. Insertion rod 404 may further include a depth marker 408 disposed thereon for showing the appropriate depth to which insertion member 400 should be inserted into the granular medium.

Figure 5A:
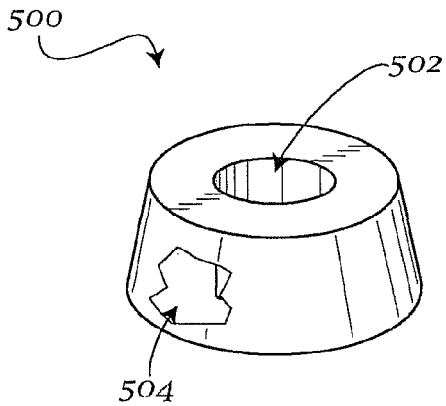
FIG. 5*a* is an isometric view of an exemplary embodiment of a base member for a resilient inflatable delineator pole.
Figure 5B:
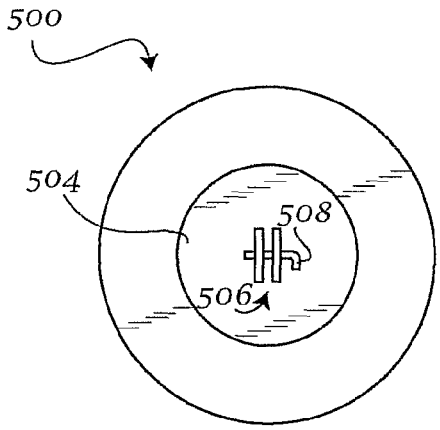
FIG. 5*b* is a top plan view of an exemplary embodiment of a base member for a resilient inflatable delineator pole.

Turning to FIGS. 5*a*-5*b*, an exemplary embodiment of a base member 500 may be shown. Base member 500 may be adapted to maintain a delineator pole 100/200 upright on a hard, non-penetrable surface. To that end, base member 500 may have a weight sufficient to maintain delineator pole 100/200 upright when the delineator pole is impacted. Alternatively, base member 500 may include an interior chamber 504 therein into which a liquid or solid material may be deposited so as to provide the necessary weight, as well as an aperture through which the material may be deposited. Base member 500 may further include a recess 502 that is sized and shaped to snugly receive a bottom portion of delineator pole 100/200. Furthermore, base member 500 may include a slit 508 within which flap 116/216 of the delineator pole may be received. A pin 506 may be removably coupled to base member 500 and insertable through slit 504. Pin 506 can thus be inserted through aperture 118/218 of flap 116/216 so as to removably couple the delineator pole to base member 500.

In operation, the delineator pole 100/200 may be transported in a deflated state to a desired location. At the desired location, the user may insert hook 406 of insertion member 400 into aperture 118/218 of the delineator pole. Insertion member 400 may then be inserted into the granular medium until a desired depth, for example until depth marker 408 is level with the surface of the granular medium. As the insertion member is inserted into the granular medium, it carries the bottom portion of the delineator pole to the desired depth. Alternatively, the delineator pole may be inserted into recess 502 of base 500 and coupled thereto by inserting pin 508 through aperture 118/218. Subsequently, the delineator pole may be inflated via the inflation valve.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A resilient inflatable gate, comprising:

a pair of resilient inflatable delineator poles;

at least one resilient transverse inflatable beam coupled to each of the pair of delineator poles; and a marker coupled to the at least one transverse inflatable beam;

wherein each delineator pole comprises an elongated enclosure formed from a pair of sheets of material, a hollow retention cone disposed at a bottom end of the elongated enclosure, a flap disposed at a bottom end of the retention cone and having an aperture defined therein, a valve disposed on the elongated enclosure and in communication with the interior chamber, and a protective sleeve enclosing a portion of the elongated enclosure.

* * * * *